US007116204B2

(12) United States Patent
Fushimi

(10) Patent No.: US 7,116,204 B2
(45) Date of Patent: Oct. 3, 2006

(54) LEAKAGE TRANSFORMER

(75) Inventor: Tadayuki Fushimi, Haramachi (JP)

(73) Assignee: Sumida Corporation, Tokyo (JP)

( * ) Notice: Subject to any disclaimer, the term of this patent is extended or adjusted under 35 U.S.C. 154(b) by 34 days.

(21) Appl. No.: 10/939,251

(22) Filed: Sep. 9, 2004

(65) Prior Publication Data

US 2005/0068149 A1 Mar. 31, 2005

(30) Foreign Application Priority Data

Sep. 25, 2003 (JP) ..... 2003-334172

(51) Int. Cl.
*H01F 27/30* (2006.01)

(52) U.S. Cl. ..... 336/208; 336/198; 336/192

(58) Field of Classification Search ..... 336/192, 336/198, 208
See application file for complete search history.

(56) References Cited

U.S. PATENT DOCUMENTS 4,316,069 A * 2/1982 Fitzmayer ..... 219/749
5,034,854 A * 7/1991 Matsumura et al. ..... 361/744
5,153,550 A * 10/1992 Sugiura et al. ..... 336/192
5,281,942 A * 1/1994 Stokes ..... 336/192
5,359,313 A * 10/1994 Watanabe et al. ..... 336/178
5,466,992 A * 11/1995 Nemirow et al. ..... 315/276
6,384,704 B1 * 5/2002 Motomura ..... 336/192
6,480,085 B1 * 11/2002 Chiang et al. ..... 336/198
6,587,023 B1 * 7/2003 Miyazaki et al. ..... 336/83
6,650,218 B1 * 11/2003 Fushimi ..... 336/178
6,714,111 B1 * 3/2004 Suzuki ..... 336/110

* cited by examiner

*Primary Examiner*—Anh Mai
(74) *Attorney, Agent, or Firm*—Reed Smith LLP

(57) ABSTRACT

A leakage transformer capable of preventing occurrence of a short-circuit of a secondary winding and is also capable of restraining a distance between terminals from becoming wide is provided. A leakage transformer (10) has a structure such that a secondary winding (71) is stacked and arranged in a height direction with respect to a primary winding (70), and comprises a plurality of primary side terminals (35*b* to 35*e*) to which one end and the other end of the primary winding (70) are respectively bound. Further, the leakage transformer (10) comprises a first terminal block (32*a*) comprising a first wrapping terminal (36) to which one end of the secondary winding (71) is bound and a second terminal block (32*b*) comprising second wrapping terminals (38*b*, 38*c*) to which the other end of the secondary winding (71) is bound.

9 Claims, 7 Drawing Sheets

LEAKAGE TRANSFORMER

BACKGROUND OF THE INVENTION

1. Field of the Invention

The present invention relates to a leakage transformer used in a DC/AC inverter circuit or the like, which is used in a lighting circuit or the like of a cold cathode fluorescent lamp (CCFL) in a display device of a television monitor or a personal computer for example.

2. Description of the Related Art

A display device of a personal computer or the like has a lighting circuit of a cold cathode fluorescent lamp. In this lighting circuit, a leakage transformer for driving the display device by applying a high voltage is generally used.

For a leakage transformer of this kind, there exists a structure disclosed in Patent Publication No. 2628524 (refer to Claim 1, paragraphs No. 0010 and 0011, and FIG. 1 and FIG. 5) and in Japanese Patent Application Laid-open No. 2002-299134 (refer to paragraphs No. 0016 and 001, and FIG. 5). In the structure disclosed in these patent documents, one end and the other end of a primary winding are connected to two terminals which are different from each other and project from one terminal block. Further, one end and the other end of a secondary winding are connected to two terminals which are different from each other and project from the other terminal block.

SUMMARY OF THE INVENTION

In the structure disclosed in the above-described patent documents, both the ends of the secondary winding are connected to the two terminals projecting from the same terminal block. In other words, the one end and the other end of the secondary winding are arranged in a state adjacent to each other. Accordingly, when dust or the like adheres to the two terminals to which are connected the one end and the other end of the secondary winding to bridge them, there is a risk of short-circuit occurring between the one end and the other end, which are the high voltage side and the low voltage side of the secondary winding. When such a short-circuit occurs, the leakage transformer may be damaged since the potential difference between the one end and the other end of the secondary winding is high.

In order to prevent such a problem, it is possible to adopt a structure in which a distance between the two terminals to which the one end and the other end of the secondary winding are connected is widened. However, when such a structure with a widened distance is adopted, the leakage transformer becomes wide, so that the leakage transformer itself becomes large. As a result, such a case goes against a request of making the leakage transformer smaller.

The present invention is made in view of the above-described situation, and an object thereof is to provide a leakage transformer that is capable of preventing occurrence of a short-circuit of a secondary winding and is also capable of restraining a distance between terminals from becoming wide.

In order to solve the above-described problems, a leakage transformer of the present invention comprises: a primary winding constituted by winding a conducting wire; a secondary winding arranged to be stacked in a height direction of the primary winding and constituted by winding a conducting wire that is different from the conducting wire of the primary winding; a first terminal block comprising a plurality of primary side terminals to which one end and the other end of the primary winding are respectively bound and a first wrapping terminal to which one end of the secondary winding is bound; and a second terminal block comprising a second wrapping terminal to which the other end of the secondary winding is bound.

In this structure, the other end of the secondary winding is bound to the second wrapping terminal which the second terminal block comprises. Further, the one end of the secondary winding is bound to the first wrapping terminal which the first terminal block comprises. Accordingly, the one end and the other end of the secondary winding are provided respectively on different terminal blocks. Therefore, it is possible to prevent a short-circuit of the one end and the other end of the secondary winding caused by arranging them in a state adjacent to the same terminal block.

By preventing such a short-circuit, the leakage transformer is prevented from being damaged. Especially, between the one end and the other end of the secondary winding, a high potential difference occurs due to excitation. Therefore, when the short-circuit is prevented as described above, the leakage transformer is favorably prevented from being damaged. Further, it also becomes possible to restrain a distance between terminals to which the secondary winding is connected from becoming wide.

Further, another invention of the leakage transformer comprises, in addition to the above-described invention: a plurality of two-step coil bobbins each having a first winding frame portion to which the primary winding is wound and a second winding frame portion to which the secondary winding is wound; an adjustment coil bobbin arranged between the plurality of two-step coil bobbins and to which an adjustment portion for adjusting a magnetic coupling of the primary winding is wound; and a core having pillar portions holding the two-step coil bobbins and the adjustment coil bobbin respectively, side walls surrounding outside of the pillar portions, and a recessed portion surrounded by the side walls into which the two-step coil bobbins and the adjustment coil bobbin are fitted, wherein the two-step coil bobbins integrates the first terminal block and the second terminal block.

In this structure, the primary winding and the secondary winding are wound on the first winding frame portion and the second winding frame portion, respectively. In this case, since the first winding frame portion and the second winding frame portion are provided on the two-step coil bobbin, only one coil bobbin is needed to be provided as compared to a case that two coil bobbins are stacked in a height direction. Accordingly, the number of parts can be reduced, and the number of steps for assembling the coil bobbin can be reduced. Further, the two-step coil bobbin integrates the first terminal block and the second terminal block, so that it is possible to prevent problems such as loosening and breaking of winding of the secondary winding after the one end of the secondary winding is bound to the first wrapping terminal and the other end thereof is bound to the second wrapping terminal. Therefore, as compared to a case that the terminal blocks are separate bodies, the assembly becomes easy.

Further, since the coil bobbins are not stacked in a height direction, it becomes possible to lower the height of the leakage transformer. Further, the adjustment coil bobbin is provided, and the adjustment portion of the primary winding is wound on this adjustment coil bobbin. Accordingly, the adjustment portion can be securely held by the adjustment coil bobbin. Further, the primary winding is wound on the first winding frame of the two-step coil bobbin. Accordingly, when attaching the primary winding, bonding of the primary winding becomes not necessary, so that a cost thereof can be reduced.

Further, in another invention of the leakage transformer, in addition to the above-described invention, the first wrapping terminal is provided so that a direction of a tip thereof is oblique with respect to a direction of tips of the primary side terminals in a state that a distance between a tip side of the first wrapping terminal and tip sides of the primary side terminals is wider than a distance between a root of the first wrapping terminal on the first terminal block and roots of the primary side terminals on the first terminal block.

In this structure, as a position on the first wrapping terminal approaches the tip side thereof, a distance between the position and the primary side terminals becomes wider. Accordingly, a distance between the first wrapping terminal and the primary side terminals is not needed to be taken larger than necessary. Further, as a position on the first wrapping terminal approaches the tip side thereof, a distance between the position and the primary side terminal becomes wider, so that even when the one end of the secondary winding is wound on the first wrapping terminal, the one end is prevented from contacting the primary side terminals.

Further, in another invention of the leakage transformer, in addition to the above-described invention, a direction of a tip of the first wrapping terminal is oblique in an angle range of approximately 30 to 60 degrees with respect to a direction of tips of the primary side terminals.

In this structure, a tip side of the first wrapping terminal is effectively widened with respect to tip sides of the primary side terminals. Accordingly, the secondary winding can be favorably wound on the first wrapping terminal.

Further, in another invention of the leakage transformer, in addition to the above-described invention, the first wrapping terminal is electrically connected to a ground terminal to be connected to a ground, and the ground terminal is arranged adjacent to the first wrapping terminal.

In this structure, when the one end of the secondary winding is bound to the first wrapping terminal, the one end of the secondary winding is in a state of being electrically connected to the ground. Thus, the one end becomes a reference potential. Further, as a result of electrical connection of the both, the one end of the secondary winding bound to the first wrapping terminal may contact the ground terminal. Accordingly, it is not needed to be more cautious than necessary when winding the one end of the secondary winding on the first wrapping terminal.

Further, in another invention of the leakage transformer, in addition to the above-described invention, each of the two-step coil bobbins has an upper flange portion, a middle flange portion, and a lower flange portion, the first winding frame portion is provided between the upper flange portion and the middle flange portion, and the second winding frame portion is provided between the middle flange portion and the lower flange portion.

In this structure, the middle flange portion of the two-step coil bobbin combines the roles of a lower flange portion of the first winding frame portion and an upper flange portion of the second winding frame portion, so that one flange portion is omitted as compared to a case that two coil bobbins are stacked in a height direction. Therefore, the height can be lowered by a height of one flange portion, so that it becomes possible to reduce the height of the leakage transformer.

Further, in another invention of the leakage transformer, in addition to the above-described invention, the first wrapping terminal is provided in a bar-shape body, and tip sides of the primary side terminals and a ground terminal project toward a bottom surface of the core farther than the first wrapping terminal.

In this structure, height positions of the tip sides of the primary side terminals and the tip side of the first wrapping terminal are different, so that the one end of the secondary winding becomes easy to be wound on the first wrapping terminal. Further, since the tip sides of the primary side terminals and the ground terminal project toward the bottom surface side of the core, the tip sides of the primary side terminals and the ground terminal become easy to be connected to a circuit board or the like.

Further, in another invention of the leakage transformer, in addition to the above-described invention, the core comprises: a case core comprising the pillar portions provided to stand upward from a bottom surface and the side walls provided to stand upward at an outer peripheral portion of the bottom surface; and a cover core attached to the case core, the two-step coil bobbins and the adjustment coil bobbin being accommodated in a space between the case core and the cover core.

In this structure, the two-step coil bobbins and the adjustment coil bobbin are accommodated in a space between the case core provided by the side walls and the cover core. Then, between the case core having the pillar portions and the side walls and the cover core, a magnetic path can be provided, so that the secondary winding can be favorably excited.

Further, in another invention of the leakage transformer, in addition to the above-described invention, a root of the first wrapping terminal on the first terminal block is located on a more central side in a short side direction of a case core than roots of the primary side terminals and the ground terminal on the first terminal block.

In this structure, the root and the tip side of the first wrapping terminal are located on a more central side in a short side direction than the roots and the tip sides of the primary side terminals and the ground terminal. Accordingly the first wrapping terminal is in a state more back down than the primary side terminals and the ground terminal. Accordingly, when the tip sides of the primary side terminals are dipped in a solder bath to solder the primary side terminals to a circuit board, the tip side of the first wrapping terminal is not dipped in the solder bath. Thus, a problem such as breaking the one end of the secondary winding with a small diameter wound on the first wrapping terminal by heat or the like for example does not occur.

According to the present invention, lowering of a height of a leakage transformer can be realized. Further, a manufacturing cost of the leakage transformer can be reduced.

DETAILED DESCRIPTION OF THE PREFERRED EMBODIMENT

Figure 1:
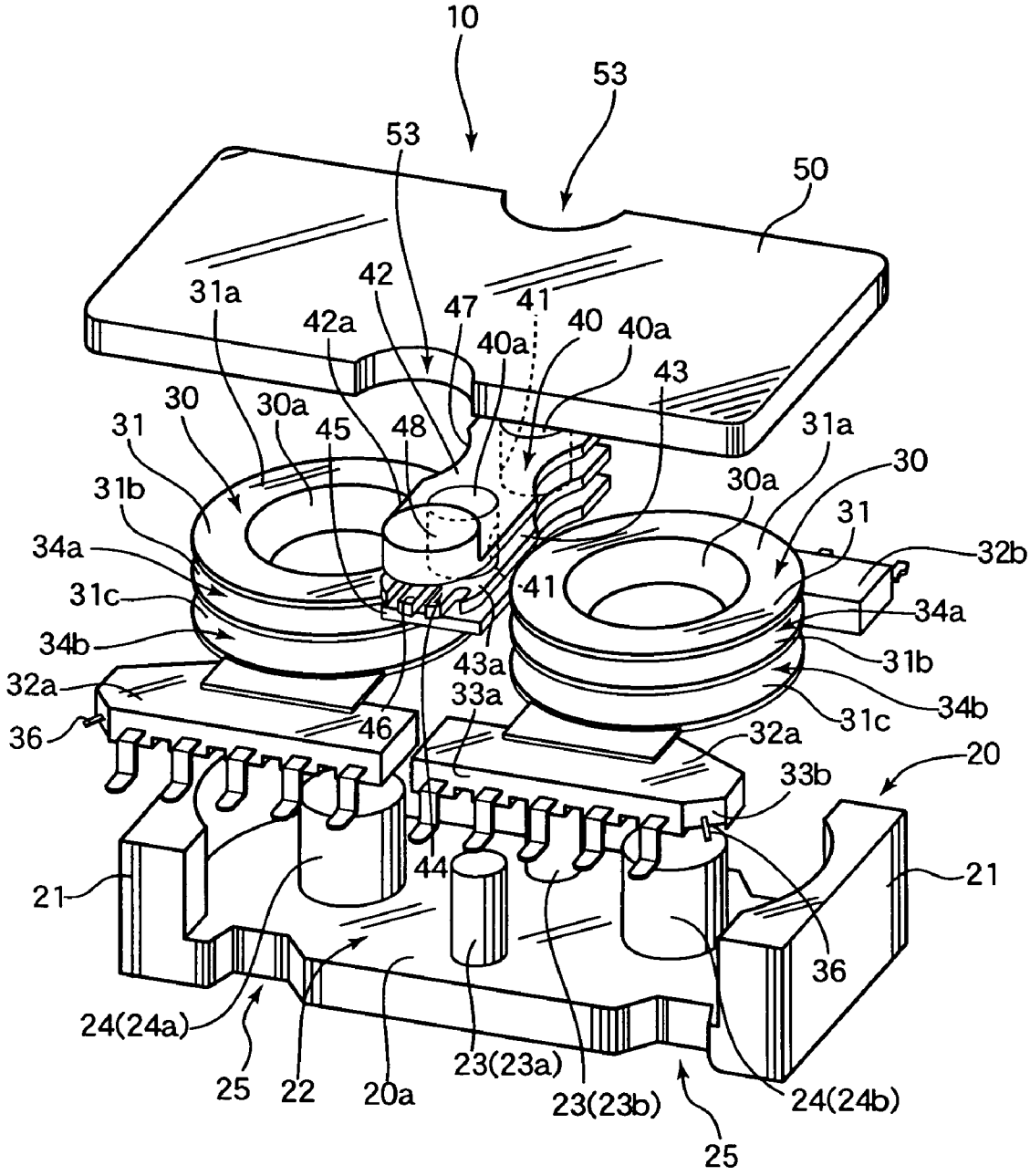
FIG. 1 is an exploded perspective view showing the structure of a leakage transformer according to one embodiment of the present invention.
Figure 2:
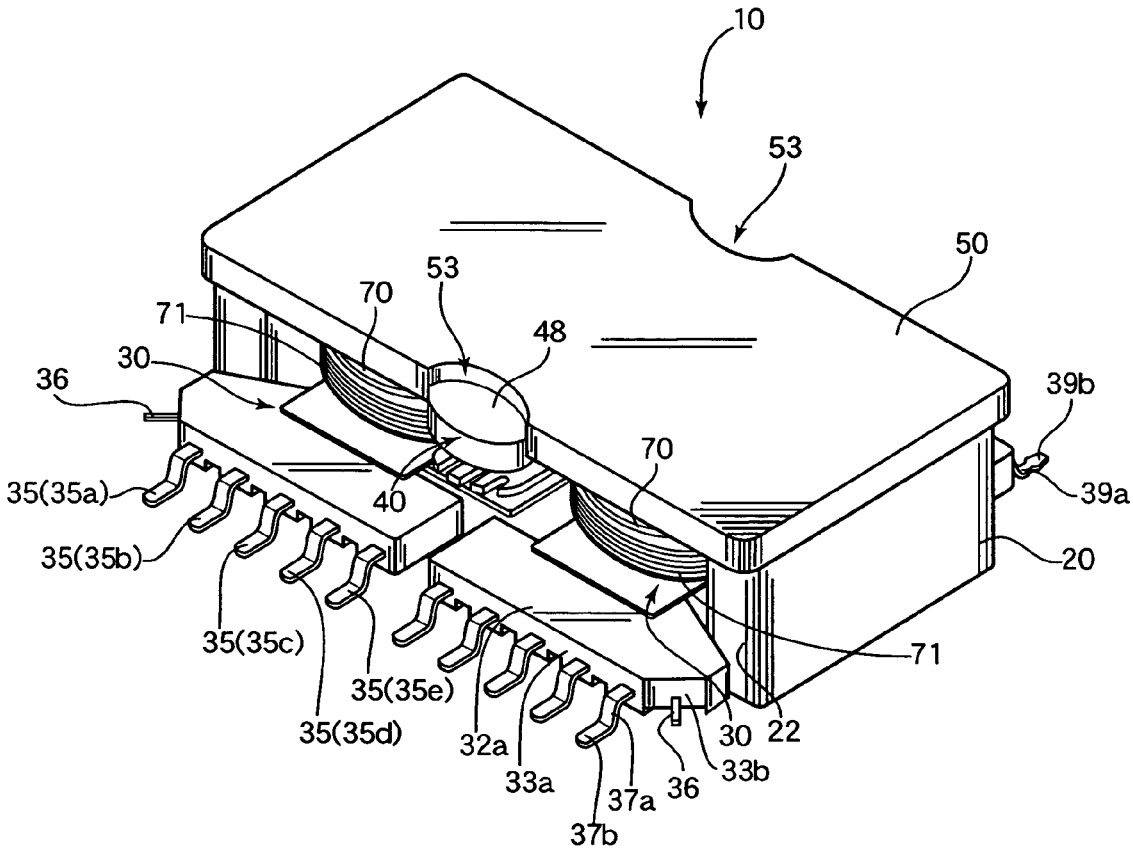
FIG. 2 is a perspective view showing the entire leakage transformer of FIG. 1.
Figure 3:
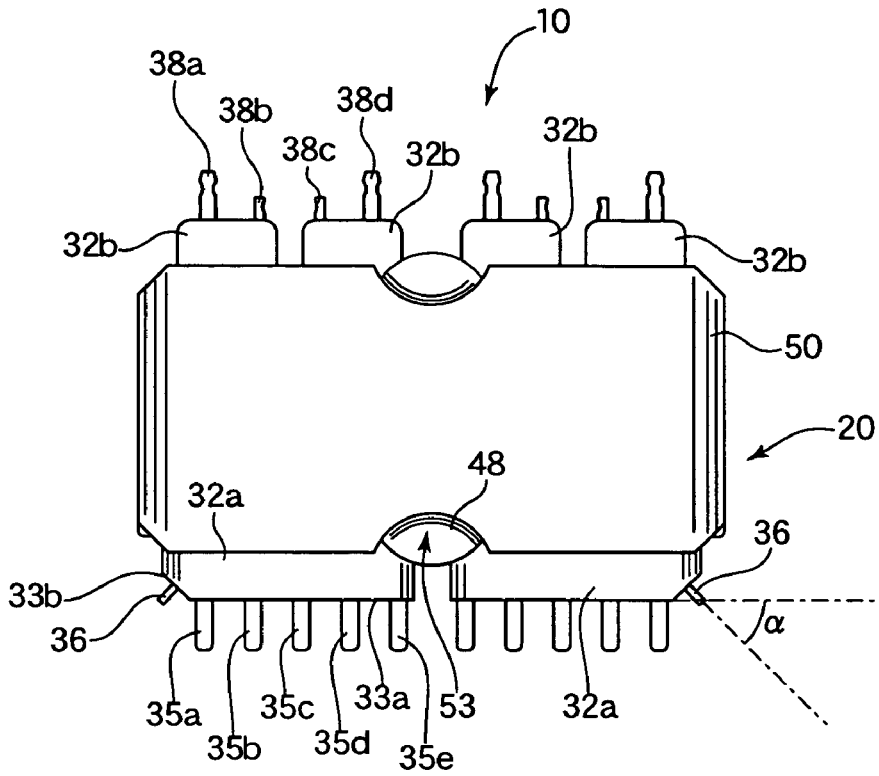
FIG. 3 is a plan view showing the structure of the leakage transformer of FIG. 1.
Figure 4:
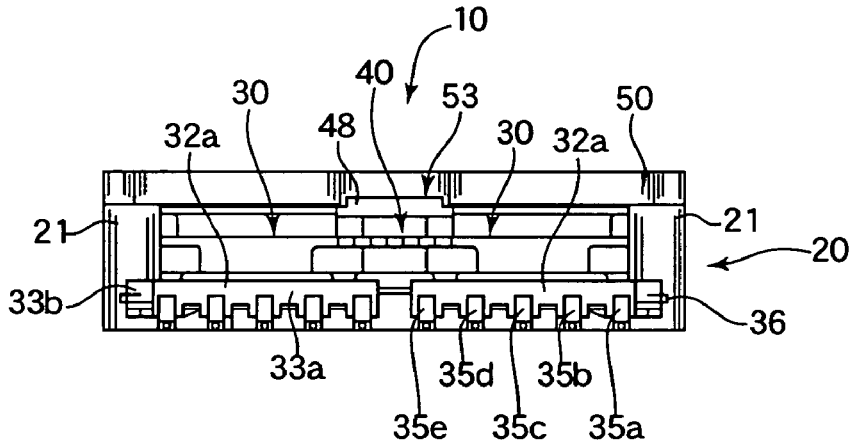
FIG. 4 is a front view showing the structure of the leakage transformer of FIG. 1.
Figure 5:
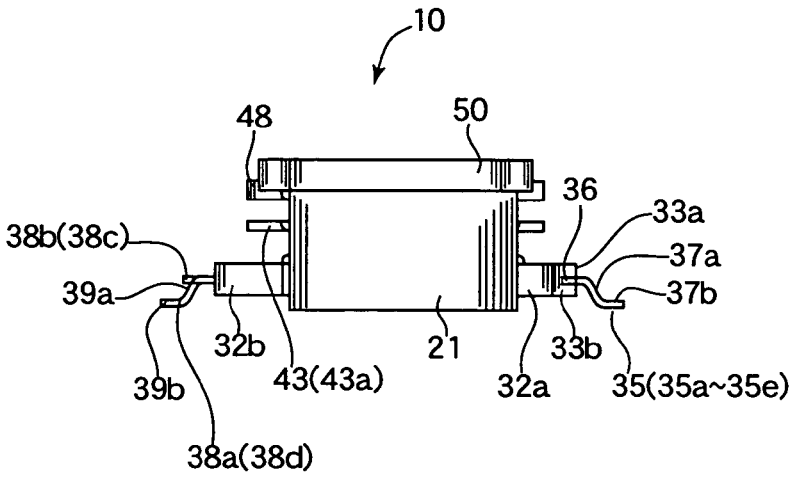
FIG. 5 is a side view showing the structure of the leakage transformer of FIG. 1.
Figure 6:
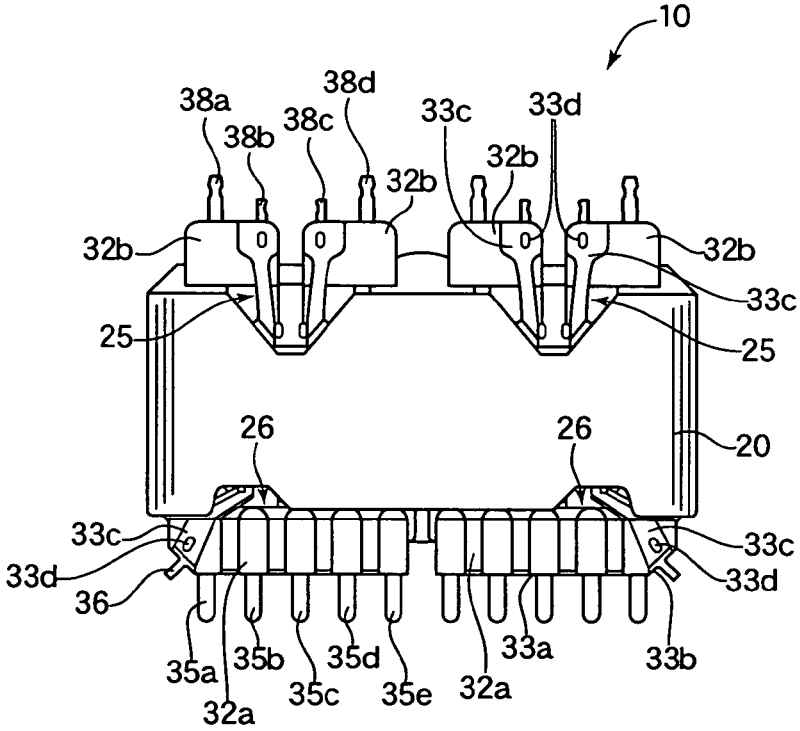
FIG. 6 is a rear view showing the structure of the leakage transformer of FIG. 1.

Hereinafter, a leakage transformer according to one embodiment of the present invention will be described based on FIG. 1 to FIG. 12. FIG. 1 is an exploded perspective view showing the structure of a leakage transformer 10, and FIG. 2 is a perspective view showing the entire leakage transformer 10. Further, FIG. 3 shows a plan view, FIG. 4 shows a front view, FIG. 5 shows a side view, and FIG. 6 shows a rear view of the leakage transformer 10.

The leakage transformer 10 has, as shown in FIG. 1, a case core 20, two-step coil bobbins 30, an adjustment coil bobbin 40, and a cover core 50 as major components. The case core 20 and the cover core 50 are constituted of a magnetic material having an insulation characteristic. An example of the magnetic material is a nickel-based ferrite core. However, the material of the case core 20 and the cover core 50 is not limited thereto, which maybe other magnetic material such as a permalloy. Further, the two-step coil bobbins 30 and the adjustment coil bobbin 40 are constituted of a material that is insulative and non-magnetized, such as resin for example.

As shown in FIG. 1, the case core 20 is an element constituting a part of the core and is formed in a rectangular parallelepiped shape whose planar shape is a substantially rectangular shape. Further, the case core 20 has side walls 21 on both sides in a long side direction (substantially left and right direction in FIG. 1), and a part surrounded by these side walls 21 is a recessed portion 22 for placing the two-step coil bobbins 30 and so on. Accordingly, in the recessed portion 22, although both the sides in the long side direction of the case core. 20 are closed by the side walls 21, edges in a short side direction (substantially height direction in FIG. 3) of the case core 20 are open.

Further, four pillar portions 23, 23, 24, and 24 are provided on the case core 20. The pillar portions 23, 23, 24, and 24 project upward so as to depart from a bottom surface 20*a*. These pillar portions 23, 23, 24, and 24 exist on two diagonal lines which are orthogonal to each other along a short side direction and a long side direction of the recessed portion 22. Among them, the pillar portions 23 and 23 along the orthogonal line in the short side direction are inserted into inserting holes 40*a* and 40*a* of the adjustment coil bobbins 40, which will be described later. Further, the pillar portions 24 and 24 along the diagonal line in the long side direction are inserted into center holes 30*a* and 30*a* of the two-step coil bobbins 30, which will be described later. Further, the diameter of the respective pillar portions 23 is smaller than that of the respective pillar portions 24. However, the diameter of the respective pillar portions 23 may be formed larger than that of the respective pillar portions 24.

Incidentally, in the following description, the respective pillar portions 23 having the smaller diameter are referred to as a first pillar portion 23. Further, the respective pillar portions 24 having the larger diameter than that of the first pillar portion 23 are referred to as a second pillar portion 24. Further, an upper side means a side to which the cover core 50 is attached when seen from the bottom surface 20*a* of the case core 20. Further, a lower side means the bottom surface 20*a* of the case core 20 when seen from the attaching side of the cover core 50. Furthermore, one of the first pillar portions 23 which exists on the near side in FIG. 1 is referred to as a first pillar portion 23*a*, and the other one exists on the far side in FIG. 1 is referred to as a first pillar portion 23*b*. Further, one of the second pillar portions 24 which exists on the left side in FIG. 1 is referred to as a pillar portion 24*a*, and the other one which exists on the right side in FIG. 1 is referred to as a pillar portion 24*b*.

Further, each of the two-step coil bobbins 30 has, as shown in FIG. 1 and FIG. 2, a winding portion 31 on which a primary winding 70 and a secondary winding 71 are wound, and a first terminal block 32*a* and a second terminal block 32*b* integrally provided with the winding portion 31.

The winding portion 31 has a substantially circular planar shape. Further, an upper flange portion 31*a*, a middle flange portion 31*b*, and a lower flange portion 31*c* are provided on the winding portion 31 in order from the top toward the bottom. Here, a portion surrounded by the upper flange portion 31*a* and the middle flange portion 31*b* is a first winding frame portion 34*a* on which the primary winding 70 is wound. Further, a portion surrounded by the middle flange portion 31*b* and the lower flange portion 31*c* is a second winding frame portion 34*b* on which the secondary winding 71 is wound.

Incidentally, in FIG. 1, the upper flange portion 31*a*, the middle flange portion 31*b*, and the lower flange portion 31*c* are formed corresponding to the winding portion 31 having a substantially circular planar shape so as to cover the entire circumference of the substantially circular shape. Thus, in FIG. 1, the winding portion 31 has an appearance of a pulley shape having two-step recesses. However, the upper flange portion 31*a* and the middle flange portion 31*b* are not necessarily formed along the entire circumference. On the winding portion 31, the primary winding 70 is wound only on a side where the two two-step coil bobbins 30 do not oppose each other (refer to FIG. 9), and therefore it is possible to adopt a structure such that the upper flange portion 31*a* and the middle flange portion 31*b* are not formed on a side where the two-step coil bobbins 30 oppose each other, and thus the first winding frame portion 34 does not exist on that side.

Further, the first terminal block 32*a* and the second terminal block 32*b* are located on a lower side than the winding portion 31 in FIG. 1. The first terminal block 32*a* is on a near side in FIG. 1 and is a portion projecting downward in FIG. 3. On this first terminal block 32*a*, a side surface 33*a* and a side surface 33*b* are formed. Among them, the side surface 33*a* is a side surface orthogonal to the short side direction of the leakage transformer 10.

Further, the side surface 33*b* is formed to have a predetermined angle α (hereinafter, referred to as a slant angle α) with respect to a straight line along the side surface 33*a*. This slant angle α is, in this embodiment, 45 degrees. However, the slant angle α is not limited to 45 degrees, which can be set to an appropriate slant angle similarly to the slant angle of a wrapping terminal 36, which will be described later.

Further, as shown in FIG. 1 to FIG. 6, the side surface 33*b* is formed on a side that is close to both the ends in the long side direction of the leakage transformer 10, and is not close to a side where the two-step coil bobbins 30 arranged in a pair opposing each other. In other words, the side surface 33*b* is formed on a corner portion of the first terminal block 32*a* on a near side in FIG. 3.

Further, terminals 35 project from the side surface 33*a*. In this embodiment, four terminals 35 are provided for example. Incidentally, in the following description, when the terminals 35 are separately referred, each of them is referred to as any of terminals 35*a* to 35*e*. Each of these five terminals 35*a* to 35*e* has a downward projecting portion 37*a* which descends downward and a surface mount portion 37*b* whose long side direction is substantially horizontal to an arrangement portion thereof. By soldering the respective terminals 35*a* to 35*e* to the arrangement portion, the terminals 35*a* to 35*e* and a circuit board as the arrangement portion are electrically connected. Further, the number of terminals 35 is not limited to five, which can be changed to various numbers such as four for example.

Further, in this embodiment, to predetermined terminals 35 among the terminals 35*b* to 35*e*, one end and the other end of the primary winding 70 are connected (bound). Incidentally, in the following description, the terminals 35*b* to 35*e* are referred to as primary side terminals 35*b* to 35*e*. Further, as will be described later, the terminal 35*a* is referred to as a ground terminal 35*a*. However, when both of them are referred, they are simply referred to as terminals 35*a* to 35*e*.

To two of the primary side terminals 35*b* to 35*e*, one end and the other end of the primary winding 70 are bound. Incidentally, two among these primary side terminal 35*b* to 35*e* to which the one end and the other end are bound can be appropriately selected.

Further, as shown in FIG. 1 to FIG. 6, a wrapping terminal 36 (equivalent to a first wrapping terminal) projects from each of the side surfaces 33*b*. The wrapping terminal 36 projects to a normal direction of the side surface 33*b*. In this embodiment, the side surface 33*b* has an angle of approximately 45 degrees with respect to the short side direction of the leakage transformer 10. Accordingly, the wrapping terminal 36 is arranged to have an angle of 45 degrees with respect to the terminals 35*a* to 35*e*. In other words, as shown in FIG. 3, a slant angle α which the direction of the tip of the wrapping terminal 36 has is approximately 45 degrees with respect to the side surface 33*a*.

Note that the slant angle α is not limited to 45 degrees, which may be any angle range as long as it provides a predetermined gap with respect to the ground terminal 35*a* adjacent to the wrapping terminal 36 and is capable of favorably binding one end of the secondary winding 71. A range of the slant angle α may be 20 to 90 degrees for example.

Further, when the slant angle α is in a range of 30 to 60 degrees, the tip side of the wrapping terminal 36 is effectively widened with respect to the tip side of the ground terminal 35*a*. Accordingly, it becomes possible to favorably wind one end of the secondary winding 71 on the wrapping terminal 36. Furthermore, the wrapping terminal 36 is not limited to the structure projecting toward the normal direction of the side surface 33*b*, and a structure projecting obliquely with respect to the normal line of the side surface 33*b* may be adopted.

Further, when the slant angle α is approximately 90 degrees, the wrapping terminal 36 cannot be described as projecting in an oblique direction with respect to the terminals 35*a* to 35*e*, but in this embodiment, such a case of 90 degrees is also included in the projection in an oblique direction.

As shown in FIG. 4 and FIG. 5, the wrapping terminal 36 projects outward from a position having substantially the same height as the terminals 35*a* to 35*e*. However, the wrapping terminal 36 is smaller in size than the terminals 35*a* to 35*e*. In other words, the wrapping terminal 36 is shorter in projecting length, smaller in width, and moreover smaller in height than the terminals 35*a* to 35*e*. However, the wrapping terminal 36 has an adequate size for binding one end of the secondary winding 71 by winding it only a predetermined times.

Further, the wrapping terminal 36 is connected electrically to the ground terminal 35*a*. In this case, the wrapping terminal 36 and the ground terminal 35*a* may be, for example, an integrally provided product of metal, or may be connected to each other via an additional conducting wire or the like. Further, the ground terminal 35*a* is connected to a ground side of a not-shown circuit board. Accordingly, the wrapping terminal 36 is provided to be a reference potential.

Further, a second terminal block 32*b* is a portion projecting toward the far side in FIG. 1 and upward on the page in FIG. 3. In this embodiment, two secondary terminal blocks 32*b* exist per one two-step coil bobbin 30. Further, as shown in FIG. 3, FIG. 5, and FIG. 6, terminals 38 project from a side surface on an outer periphery side of the second terminal block 32*b* seen from the center of the two-step coil bobbin 30. In this embodiment, for example, four terminals 38 are provided. Incidentally, in the following description, when the terminals 38 are separately referred, each of them is referred to as any of terminals 38*a* to 38*d*.

Among these four terminals 38*a* to 38*d*, small terminals 38*b* and 38*c* having a smaller projecting length are provided inside, and the terminals 38*a* and 38*d* having a larger projecting length are provided outside. To one of these terminals 38*b* and 38*c*, the other end of the secondary winding 71 is bound. Incidentally, in the following description, the terminals 38*b* and 38*c* to which the other end of the secondary winding 71 is bound are particularly referred to as wrapping terminals 38*b* and 38*c*. Both the wrapping terminal 38*b* and the wrapping terminal 38*c* have a possibility that the other end of the secondary winding 71 is bound thereto, and the wrapping terminals 38*b* and 38*c* are equivalent to a second wrapping terminal.

Note that the terminal 38*a* and the wrapping terminal 38*b* are conductive to each other, and the wrapping terminal 38*c* and the terminal 38*d* are conductive to each other. Accordingly, the secondary winding 71 excited by the primary winding 70 outputs a predetermined potential from the wrapping terminal 38*b* to the terminal 38*a* and from the wrapping terminal 38*c* to the terminal 38*d*, respectively. Further, the terminal 38*a* and the terminal 38*d* are respectively connected to a circuit board, so that an alternating current generated by the excitation flows to a predetermined circuit existing on the circuit board.

Further, each of the terminals 38*a* and 38*d* has, similarly to the above-described terminals 35*a* to 35*e*, a downward projecting portion 39*a* which descends downward and a surface mount portion 39*b* whose lower end side is substantially horizontal to an arrangement portion thereof.

Further, as shown in FIG. 6, on a rear side of each of the first terminal block 32*a* and the second terminal block 32*a*, leading portions 33*c* are formed. The leading portions 33*c* are recessed portions where conducting wires (not-shown) of the secondary winding 71 are located when the secondary winding 71 is led from the winding portion to either the wrapping terminal 38*b* or the wrapping terminal 38*c* on the outside and is led to the wrapping terminal 36. On each of the leading portions 33*c*, a projection 33*d* is formed. The projection 33*d* is a portion capable of receiving a conducting wire by an outer surface side thereof.

Here, when the leading wire of the secondary winding 71 is led to either the wrapping terminal 38*b* or the wrapping terminal 38*c* and to the wrapping terminal 36 thereof, the leading wire is made to be in contact with the projection 33*d*. Thereafter, the leading wire is wound on the wrapping terminal 36 in a direction that the contact of the leading wire with the projection 33*d* is maintained. Thus, by winding the leading wire on either of the wrapping terminals 38*b* and 38*c* and on the wrapping terminal 36, it is possible to prevent the leading wire from becoming loose.

Note that, as shown in FIG. 1 and FIG. 6, on the case core 20, cut-out portions 25 are formed corresponding to fit of the second terminal blocks 32*b*. In this embodiment, two cut-out portions 25 are formed along one side (upper side on the page in FIG. 6) in FIG. 6. Further, on the case core 20, cut-out portions 26 for leading the leading wire to be wound on the wrapping terminal 36 are also formed on the first terminal block 32*a* side.

Further, at a position where the two-step coil bobbins 30 oppose each other, the adjustment coil bobbin 40 is arranged. The adjustment coil bobbin 40 is, as shown in FIG. 7 to FIG. 12, a portion on which an adjustment portion 70*a* of the primary winding 70 is wound. Further, the adjustment coil bobbin 40 is arranged so that the short side direction of the leakage transformer 10 is a long side direction thereof. Moreover, the adjustment coil bobbin 40 is formed symmetrically with a line passing through its center along a short side direction thereof being a boundary.

Figure 7:
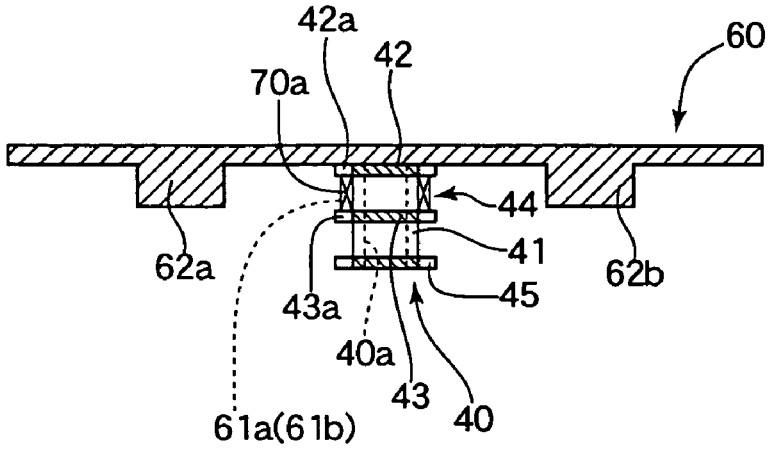
FIG. 7 is a view describing a manufacturing method of the leakage transformer of FIG. 1 and is a cross-sectional view describing a state that an adjustment coil bobbin is held by a jig.

As shown in FIG. 1 and FIG. 7, on the adjustment coil bobbin 40, a pair of cylindrical portions 41 are formed along a long side direction thereof. On the cylindrical portions 41, inserting holes 40*a* are formed so as to penetrate the adjustment coil bobbin 40 in a height direction. Into the inserting holes 40*a*, the above-described first pillar portions 23*a* and 23*b* are inserted. Further, on an upper side of the adjustment coil bobbin 40, an upper surface portion 42 in a substantially plate shape is formed. This upper surface portion 42 is a long plate formed along a long side direction of the adjustment coil bobbin 40. On the upper surface portion 42, a portion on a more end portion side than the inserting holes 40*a* is an upper flange portion 42*a* projecting toward the more end portion side in the long side direction than the cylindrical portions 41.

Further, on a lower side of the upper surface portion 42, a middle surface portion 43 is provided in a state opposing the upper surface portion 42. The middle surface portion 43 is provided so as to be a plate shape that is substantially the same as the above-described upper surface portion 42. Further, on the middle surface portion 43, a portion on a more end portion side than the inserting holes 40*a* is a lower flange portion 43*a* projecting more toward the end portion side in the long side direction than the cylindrical portions 41. An area surrounded by the lower flange portion 43*a*, the upper flange portion 42*a*, and outer peripheral surfaces of the cylindrical portions 41 is an adjustment winding frame portion 44 on which the adjustment portion 70*a* is wound.

Further, on the lower flange portion 43*a*, a tip-split portion 46 is formed on a near side portion in FIG. 1. The tip-split portion 46 functions as a guide to lead the primary winding 70 to any one of the primary side terminals 35*b* to 35*e*. Here, as shown in FIG. 1, the tip-split portion 46 has plural slit-shape portions, and the primary winding 70 is inserted through these slit portions. Thus, the primary winding 70 is guided downward and bound to any one of the primary side terminals 35*b* to 35*e*. Incidentally, this tip-split portion 46 may be omitted.

Further, the upper surface portion 42, the middle surface portion 43 and a bottom surface portion 45 located below the middle surface portion 43 are provided at a position between the two-step coil bobbins 30 arranged to oppose each other. Accordingly, on each of side edge portions located on both ends in the short side direction of the upper surface portion 42, the middle surface portion 43, and the bottom surface portion 45, a bending recessed portion 47 is formed. The respective bending recessed portions 47 are formed in a shape corresponding to the outer peripheral edge portions of the upper flange portion 31*a*, the middle flange portion 31*b*, and the lower flange portion 31*c* of the two-step coil bobbin 30.

In this embodiment, an end portion side in the long side direction on the upper flange portion 42*a*, there is formed a positioning projection 48 as shown in FIG. 1 to FIG. 3 to be fitted into a cut-out portion 53 which will be described later. The positioning projection 48 is formed to be a projection having a planar shape of substantially almond shape. In this embodiment, two positioning projections 48 are arranged along the long side direction of the adjustment coil bobbin 40.

Incidentally, the shape of the positioning projection 48 is not limited to the shape shown in FIG. 1 to FIG. 3. For example, a positioning projection having an appearance of substantially trapezoidal shape may be used. Besides that, it is possible to form the positioning projection in various shapes such as a columnar shape.

Figure 12:
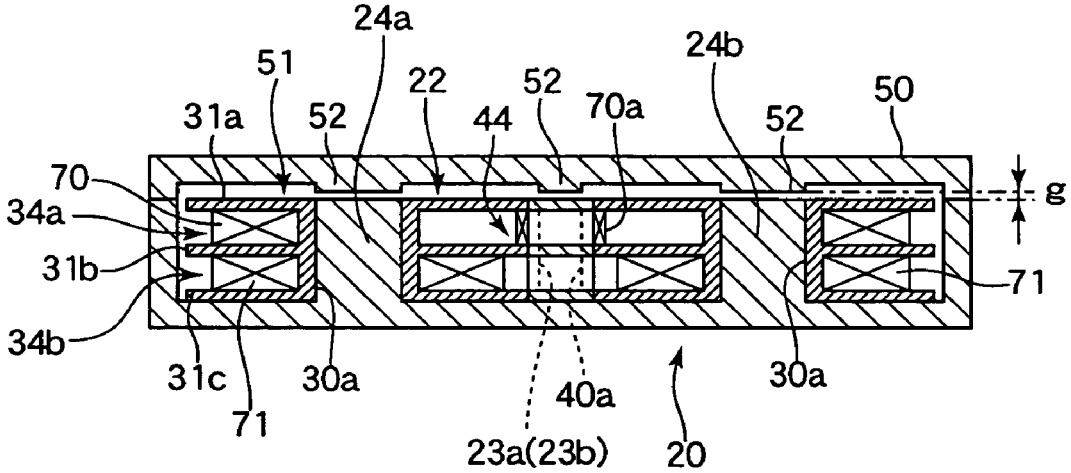
FIG. 12 is a view describing the manufacturing method of the leakage transformer of FIG. 1 and is a cross-sectional view showing a state that the cover core is attached and the leakage transformer is completed.

Further, an upper side of the case core 20, the cover core 50 as a component of the core is located. On the cover core 50, as shown in FIG. 12 for example, a recessed portion 51 corresponding to the above described recessed portion 22 is formed. On the recessed portion 51, projecting portions 52 having a small projecting length are formed so as to oppose the above-described pillar portions 23 and 24. These projecting portions 52 oppose the pillar portions 23 and 24 with a small gap "g" (refer to FIG. 12) therebetween in a state that the cover core 50 is attached to the case core 20.

Note that, in this embodiment, the projecting portions 52 are not inserted into the center holes 30*a* of the two-step coil bobbins 30. However, the projecting portions 52 may be configured to be inserted into the center holes 30*a* of the two-step coil bobbins 30 together with the pillar portions 23 and 24. In this case, the height position of top end surfaces of the two-step coil bobbins 30 may be higher than top ends of the pillar portions 23 and 24. Thus, the projecting portions 52 are inserted into the center holes 30*a*, so that the cover core 50 can be prevented from being displaced without forming the positioning projections 48 and the cut-out portions 53, which will be described later.

Further, the recessed portion 51 of the cover core 50 may have a flat structure without forming the projecting portions 52 or the like. In this case, the pillar portions 23 and 24 may be configured to be slightly shorter than the side walls 21, so that a gap is formed between each of the pillar portions 23 and 24 and the cover core 50.

Further, the cover core 50 has, as shown in FIG. 1 to FIG. 3, a planar shape in substantially rectangular shape, and the cut-out portion 53 being cut out in an arc shape upward from a longer side of this substantially rectangular shape. In this cut-out portion 53, the above-described positioning projection 48 is fitted. In this embodiment, two cut-out portions 53 are formed in total, one on each of two longer sides. Note that the shape of the cover core 50 may be changed in various forms. For example, the appearance of the cover core 50 may be a substantially analogous shape that is slightly bigger to close the recessed portion 22 so as to favorably close the recessed portion 22.

A manufacturing method of the leakage transformer 10 having the above-described structure will be described below. Note that this manufacturing method will be described based on FIG. 7 to FIG. 12. Further, in the description of this manufacturing method, the structure of a jig 60 used for the manufacturing will also be described.

First, the primary winding 70 is wound on the adjustment winding frame portion 44 to form the adjustment portion 70*a*. At this time, the winding number of the primary winding 70 may be at least 2 to 3 windings for example. When the adjustment portion 70*a* is formed, the other portion of the primary winding 70 that is not wound is kept in a state of being extended by a winding nozzle of a winding machine.

Next, the adjustment coil bobbin 40 is attached to the jig 60 (refer to FIG. 7). The jig 60 is formed to have a planar shape which does not interfere with the positioning projection 48 and the like. On the jig 60, first projecting portions 61*a* and 61*b* are formed (refer to FIG. 7 and others). The first projecting portions 61*a* and 61*b* have the same diameter as that of the above-described first pillar portions 23*a* and 23*b*. Therefore, when the first projecting portions 61*a* and 61*b* are inserted into the inserting holes 40*a*, the adjustment coil bobbin 40 does not become loose. Here, the adjustment coil bobbin 40 is attached in a state of being located below the jig 60 (refer to FIG. 7 and others).

Note that the step of attaching the adjustment coil bobbin 40 to the jig 60 may be carried out before the step of winding the primary winding 70 on the adjustment coil bobbin 40.

Further, on the second winding frame portion 34*b*, the secondary winding 71 is wound in advance. At this time, the other end of the secondary winding 71 is bound to either of the two wrapping terminals 38*b* and 38*c*. Next, the secondary winding 71 is wound on the second winding frame portion 34*b*. Finally, one end of the secondary winding 71 is bound on the wrapping terminal 36. Thus, winding of the secondary winding 71 is completed. Incidentally, the one end of the secondary winding 71 may be bound first to the wrapping terminal 36, and the other end of the secondary winding 71 may be bound at last to either of the two wrapping terminals 38*b* and 38*c*.

Figure 8:
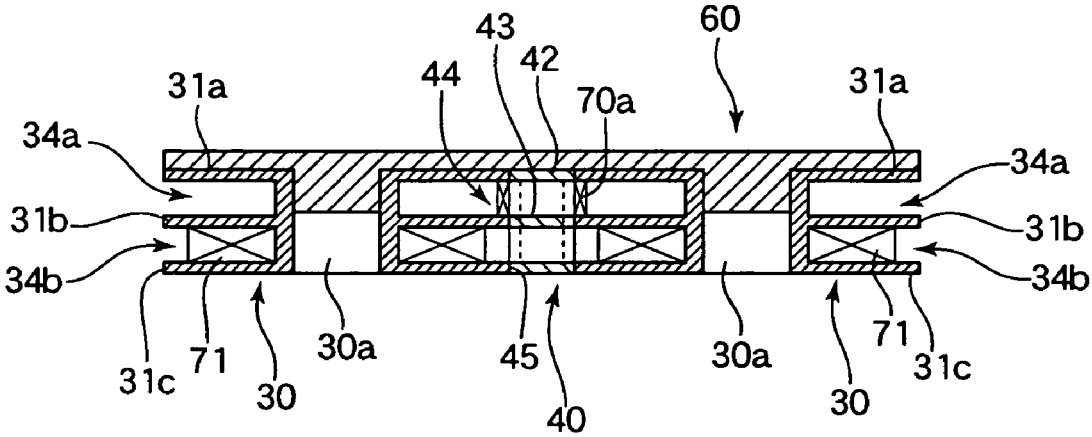
FIG. 8 is a view describing the manufacturing method of the leakage transformer of FIG. 1 and is a cross-sectional view showing a state that two-step coil bobbins are held by the jig.

After the winding of the secondary winding 71 and the attachment of the adjustment coil bobbin 40 to the jig 60, the two-step coil bobbins 30 are attached to the jig 60 (refer to FIG. 8). Here, as shown in FIG. 7 and so on, second projecting portions 62*a* and 62*b* are formed on the jig 60. These second projecting portions 62*a* and 62*b* have the same diameter as that of the above-described second pillar portions 24*a* and 24*b*. Therefore, when the second projecting portions 62*a* and 62*b* are inserted into the center holes 30*a* of the two-step coil bobbins 30, the two-step coil bobbins 30 do not become loose.

Figure 9:
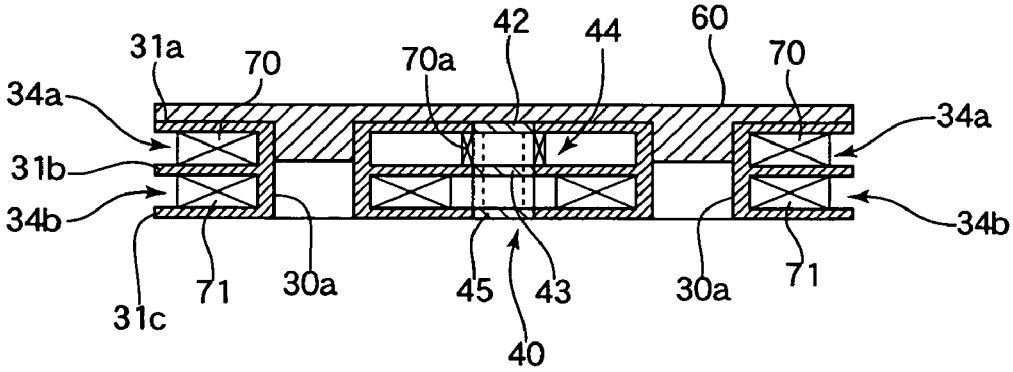
FIG. 9 is a view describing the manufacturing method of the leakage transformer of FIG. 1 and is a cross-sectional view showing a state that a primary winding is wound on first winding frame portions of the two-step coil bobbins.

After the two-step coil bobbins 30 are attached to the jig 60, the primary winding 70 is wound to the first winding frame portions 34*a* (refer to FIG. 9). At this time, the primary winding 70 after forming the above described adjustment portion 70*a* is wound. This primary winding 70 is being extended by the winding nozzle of the winding machine. In this state, the winding machine is operated so as to wind on the first winding frame portions 34*a*. Then, an extended part of the primary winding 70 is wound sequentially on the first winding frame portions 34*a*.

Figure 10:
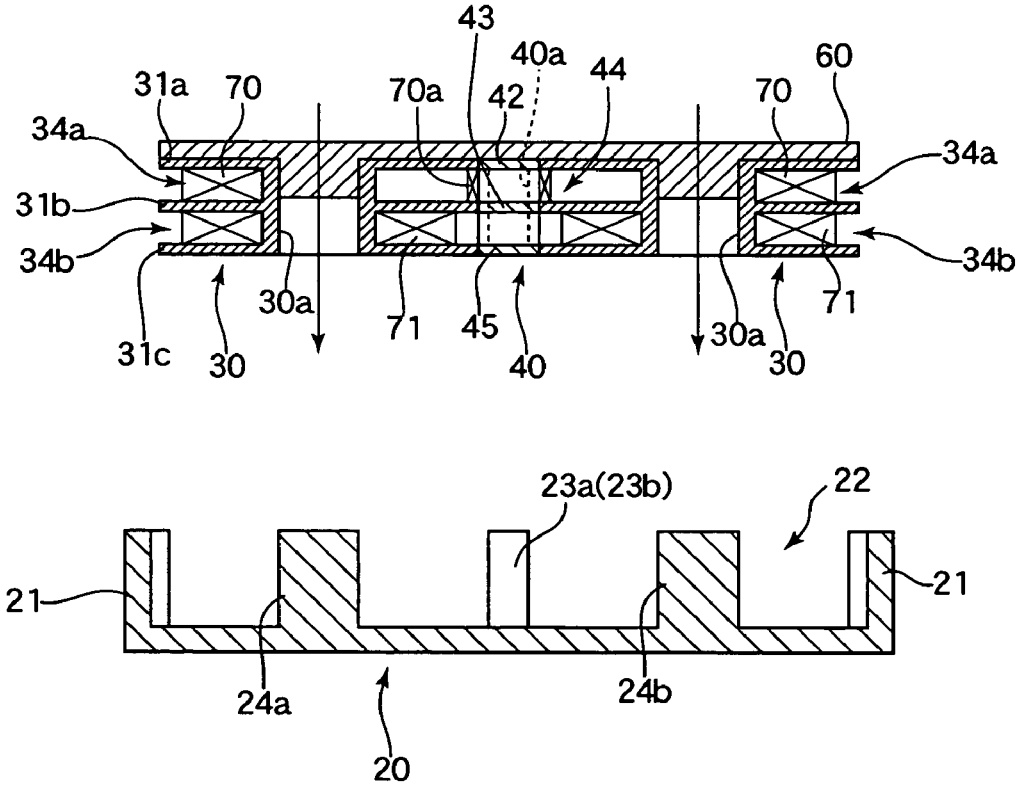
FIG. 10 is a view describing the manufacturing method of the leakage transformer of FIG. 1 and is a cross-sectional view showing a state just before the two-step coil bobbins and the adjustment coil bobbin are inserted into a case core in a state of being held by the jig.
Figure 11:
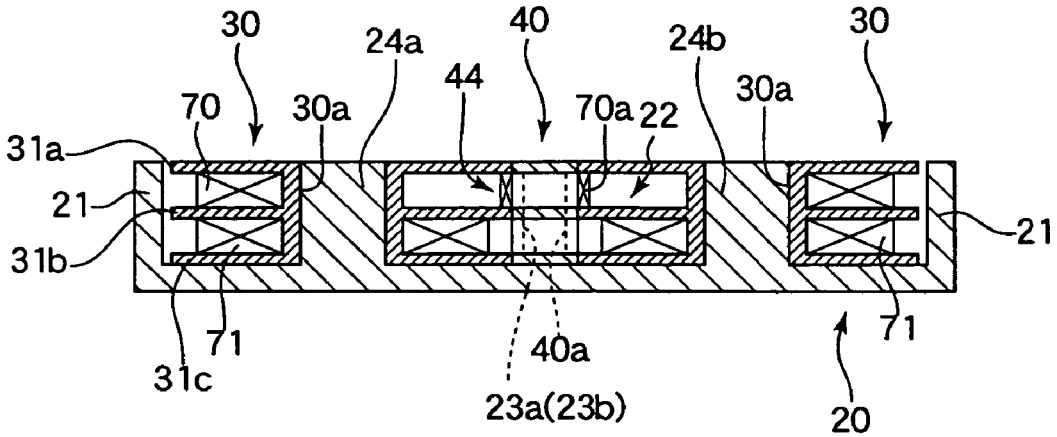
FIG. 11 is a view describing the manufacturing method of the leakage transformer of FIG. 1 and is a cross-sectional view showing a state that the two-step coil bobbins and the adjustment coil bobbin are attached to the case core.

After winding the primary winding 70 by a predetermined winding number, the adjustment coil bobbin 40 and the two-step coil bobbins 30 are fitted into the recessed portion 22 (refer to FIG. 10 and FIG. 11). At this time, tip sides of the first pillar portions 23*a* and 23*b* and the second pillar portions 24*a* and 24*b* are gradually inserted into the center holes 30*a* and the inserting holes 40*a* respectively from the downside thereof. Then, as the insertion proceeds, the jig 60 is pushed by the tip sides of the first pillar portions 23*a* and 23*b* and the second pillar portions 24*a* and 24*b*, and thus the jig 60 is removed.

Next, the cover core 50 is attached and fixed to the case core 20 so as to cover the recessed portion 22 (refer to FIG. 12). At this time, the cover core 50 is attached in a state that the positioning projections 48 are fitted into the cut-out portions 53. Further, when the cover core 50 is attached, the projecting portions 52 are in a state opposing the respective pillar portions 23 and 24 with a gap "g" as shown in FIG. 12.

Further, on a near side and a far side in FIG. 1 and FIG. 2, not-shown side wall cores may be attached to thereby cover the near side and the far side of the recessed portion 22. In this manner, open portions of the recessed portion 22 are covered by the side wall cores, so that leakage of magnetic flux to the outside is reduced.

By carrying out the above-described steps, the leakage transformer 10 becomes a completed state as shown in FIG. 2 to FIG. 6 and FIG. 12. Incidentally, after the leakage transformer 10 is completed, tip sides of the terminals 35*a* to 35*e*, 38*a*, and 38*d* are dipped in a solder bath to coat the solder on the tip sides. The tip sides and predetermined positions of a not-shown circuit board are aligned, and the both are joined. At this time, the joining may be done in a state that the solder is also coated on the circuit board side.

In the leakage transformer 10 having the above-described structure, the one end of the secondary winding 71 is bound to the wrapping terminal 36. Further, the other end of the secondary winding 71 is bound to either of the wrapping terminals 38*b* and 38*c*. Therefore, the one end and the other end of the secondary winding 71 are wired toward the terminal blocks 32*a* and 32*b* each arranged in a different direction. Thus, the distance between the one end and the other end of the secondary winding 71 is widened, so that a short-circuit to each other may be prevented even when dust or the like adheres.

Further, by preventing such a short-circuit, breakage of the leakage transformer 10 is prevented. Especially, a high potential difference occurs by excitation between the one end and the other end of the secondary winding 71. Therefore, when the short-circuit is prevented as described above, the breakage of the leakage transformer 10 is prevented favorably.

Further, the wrapping terminal 36 is provided obliquely with respect to the terminals 35*a* to 35*e*. Accordingly, as a position on the wrapping terminal 36 approaches the tip side thereof, a distance between the position and the adjacent ground terminal 35*a* becomes wider. Therefore, the distance between the wrapping terminal 36 and the ground terminal 35*a* is not needed to be wider than necessary. Especially, in the above-described embodiment, the slant angle α is made to be 45 degrees with respect to the side surface 33*a*. Therefore, the tip side of the wrapping terminal 36 is effectively widened with respect to the tip side of the ground terminal 35*a*, and it becomes possible to favorably wind the secondary winding 71 on the wrapping terminal 36.

Further, the wrapping terminal 36 projects obliquely with respect to the terminals 35*a* to 35*e*, and the tip side of the wrapping terminal 36 does not project more outward than the tip sides of the terminals 35*a* to 35*e*. Therefore, when the tip sides of the terminals 35*a* to 35*e* are dipped in the solder bath to solder the terminals 35*a* to 35*e* to the circuit board, the wrapping terminal 36 is not dipped in the solder bath. Thus, a problem such as breaking the one end of the secondary winding 71 with a small diameter that is wound on the wrapping terminal 36 by heat or the like for example does not occur.

Further, the wrapping terminal 36 is connected to the ground terminal 35*a*, and the ground terminal 35*a* is arranged in a state adjacent to the wrapping terminal 36. Accordingly, when the one end of the secondary winding 71 is bound on the wrapping terminal 36, the one end of the secondary winding 71 is in a state of being connected to the ground. Thus, the one end becomes a reference potential. Further, the secondary winding 71 bound to the wrapping terminal 36 may contact the ground terminal 35*a*, so that it is not needed to be more cautious than necessary when winding the one end of the secondary winding 71 on the wrapping terminal 36.

Furthermore, on the two-step coil bobbin 30, the first winding frame portion 34*a* and the second winding frame portion 34*b* are provided. Therefore, as compared to a conventional case that two coil bobbins are stacked vertically (refer to FIG. 10), only one coil bobbin is needed to be provided, so that the number of parts can be lowered. Thus, the number of steps for assembling the coil bobbin can be reduced.

Especially, the two-step coil bobbins 30 has the upper flange portion 31*a*, the middle flange portion 31*b*, and the lower flange portion 31*c*, and the first winding frame portion 34*a* is provided between the upper flange portion 31*a* and the middle flange portion 31*b* and the second winding frame portion 34*b* is provided between the middle flange portion 31*b* and the lower flange portion 31*c*. Therefore, the middle flange portion 31*b* combines the roles of a lower flange of the first winding frame portion 34*a* and an upper flange of the second winding frame portion 34*b*. Therefore, one flange portion is omitted as compared to a case that two coil bobbins are stacked vertically, and a height thereof can be lowered accordingly, thereby contributing to reduce the height of the leakage transformer 10.

Further, the first terminal block 32*a* and the second terminal block 32*b* are integrally provided with the two-step coil bobbin 30. Therefore, displacement of positions of the first terminal block 32*a* and the second terminal block 32*b* with respect to the two-step coil bobbin 30 does not happen. Thus, after the one end of the secondary winding 71 is bound to the wrapping terminal 36 and the other end thereof is bound to either of the wrapping terminals 38*b* and 38*c*, it is possible to prevent a problem such that winding of the secondary winding 71 becomes loose or the secondary winding 71 is broken.

Further, since the adjustment coil bobbin 40 is provided, the adjustment portion 70*a* is wound on the adjustment winding frame portion 44 of the adjustment coil bobbin 40. Thus, the adjustment portion 70*a* can be securely held by the adjustment winding frame 44.

Especially, the adjustment coil bobbin 40 has the adjustment winding frame portion 44 sectioned by the upper flange portion 42*a* and the lower flange portion 43*a*, this adjustment winding frame portion 44 serves as a guide when winding the adjustment portion 70*a*. Thus, winding of the adjustment portion 70*a* becomes secure. Further, a winding machine can be used to easily wind the primary winding 70 on the adjustment coil bobbin 40. Therefore, as compared to a case that the primary winding 70 is wound directly on the first pillar portion 23 or the like existing inside the case core 20 without providing the adjustment coil bobbin 40, the primary winding 70 can be wound without manpower, thereby improving the working efficiency.

Further, the primary winding 70 is wound in a state of being stretched over on the two first winding frame portions 34*a*. Therefore, when the primary winding 70 is wound, bonding of the primary winding is not necessary, so that a cost thereof can be reduced.

Furthermore, the two two-step coil bobbins 30 are provided, and the adjustment coil bobbin 40 is arranged at the position between the two two-step coil bobbins 30 opposing each other. Therefore, when the primary winding 70 is wound to form the adjustment portion 70*a* in advance to the winding on the two-step coil bobbins 30 and thereafter the two-step coil bobbins 30 are arranged next to each other adjacent to the adjustment coil bobbin 40, the entire primary winding 70 can be favorably held by the adjustment coil bobbin 40 and the two-step coil bobbins 30. Further, by such holding, bonding of the primary winding 70 becomes unnecessary.

Further, the wrapping terminal 36 is formed in a bar-shape body, and the tip sides of the terminals 35*a* to 35*e* project more toward the bottom surface side of the case core 20 than the wrapping terminal 36. Accordingly, height positions of the tip sides of the terminals 35*a* to 35*e* and the tip side of the wrapping terminal 36 are different. Thus, the one end of the secondary winding 71 becomes easy to be wound on the wrapping terminal 36. Further, since the tip sides of the terminals 35*a* to 35*e* project toward the bottom surface side of the case core 20, the tip sides of the terminals 35*a* to 35*e* become easy to be connected to a circuit board or the like.

Further, the core has the case core 20 and the cover core 50, and on the case core 20, there are provided the first pillar portions 23, the second pillar portions 24, and the side walls 21. Accordingly, the two-step coil bobbins 30 and the adjustment coil bobbins 40 are accommodated in the recessed portion 22 formed by the side walls 21. Then, a magnetic path can be formed between the case core 20 having the first pillar portions 23, the second pillar portions 24, and the side walls 21 and the cover core 50, so that the secondary winding 71 can be preferably excited.

Furthermore, the root of the wrapping terminal 36 is located on the more central side in the short side direction of the case core 20 than roots of the terminals 35*a* to 35*e*. Accordingly, the start point of the wrapping terminal 36 is in a state more back down than the roots of the terminals 35*a* to 35*e*. Further, in this embodiment, the root of the wrapping terminal 36 exists on the side surface 33*b* having an angle of approximately 45 degrees with respect to the short side direction of the leakage transformer 10. Accordingly, as compared to a case that the side surface 33*b* faces the same direction as the side surface 33*a*, the area of the side surface 33*b* can be taken larger, and when winding the secondary winding 71, the secondary winding 71 can be favorably received.

Further, the tip side of the wrapping terminal 36 is located on a more central side in the long side direction of the case core 20 than an end portion in the long side direction of the case core 20. Accordingly, the wrapping terminal 36 does not project more outward than the end portion in the long side direction of the case core 20. Thus, the wrapping terminal 36 does not project to the outside excessively. Therefore, when the leakage transformer 10 is arranged inside a notebook-sized personal computer or the like for example, the wrapping terminal 36 will not be an obstruction. Further, the leakage transformer 10 can be made compact as well.

In the foregoing, the one embodiment of the present invention has been described, but the present invention can be modified in various ways other than this. Hereinafter, such modification will be described.

In the above-described embodiment, the side surface 33*b* is formed on the first terminal block 32*a*, and the wrapping terminal 36 projects from this side surface 33*b*. However, it is not necessary to adopt the structure of projecting the wrapping terminal 36 from the side surface 33*b*. For example, without forming the side surface 33*b* that is oblique with respect to the short side direction of the leakage transformer 10, a side surface parallel to the short side direction may be formed, and the wrapping terminal 36 may be projected from this side surface.

Further, in the above-described embodiment, the wrapping terminal 36 is constituted by a linear bar-shape body that is thinner than the terminals 35*a* to 35*e*. However, the shape of the wrapping terminal 36 is not limited thereto. For example, the shape of the wrapping terminal 36 may be formed in a hook shape so that the one end of the secondary winding 71 can be easily bound. Further, in the above-described embodiment, the first terminal block 32*a* and the second terminal block 32*b* are integrally provided with the two-step coil bobbin 30. However, they may be each provided in a separate body. In this case, it is possible to adopt a structure such that only the first terminal block 32*a* or the second terminal block 32*b* is provided to have a separate body for example. In this case, the secondary winding 71 is bound after the separate terminal block is assembled.

Further, in the above-described embodiment, the wrapping terminal 36 and the ground terminal 35*a* are connected. However, both of them may exist independently without being connected. Further, when making them independent, the wrapping terminal 36 may be grounded.

Further, in the above-described embodiment, the two-step coil bobbin 30 is used to wind the primary winding 70 and the secondary winding 71 on the two-step coil bobbin 30. However, it is possible to adopt a structure using a coil bobbin other than the two-step coil bobbin 30. For example, a coil bobbin on which the primary winding 70 is wound and a coil bobbin on which the secondary winding 71 is wound may be each provided in a separate body, and the both may be arranged to be stacked. Also in this case, it is possible to prevent occurrence of a short-circuit between the one end and the other end of the secondary winding 71 of the high voltage side, so that the excellent operation and effect can be achieved. Thus, breakage of the leakage transformer 10 can be prevented.

Further, in the above-described embodiment, the number of two-step coin bobbins 30 is two. However, the number of two-step coil bobbins 30 is not limited to two, which can be changed to various numbers such as providing four two-step coil bobbins 30 for example. Incidentally, when providing four two-step coil bobbins 30, four second pillar portions 24 should be formed, but also in this case, the two winding frame portions 34*a* and 34*b* are included in each two-step coil bobbins 30, so that the reduction in height can be achieved. Further, bonding of the primary winding 70 is not necessary.

Further, in the above-described embodiment, the terminals 35*a* to 35*e* and the terminals 38*a* and 38*d* have the surface mount portions 37*b* and 39*b* to be mounted on a surface. However, the terminals 35*a* to 35*e* and the terminals 38*a* and 38*d* are not limited to the structure having the surface mount portions 37*b* and 39*b*, and for example, a structure may be adopted such that the terminals project downward so as to be inserted into a circuit board.

Further, the above-described leakage transformer 10 is not limited to the use as a cold cathode fluorescent lamp of a display device in a notebook-sized personal computer, and can be used in various electronic devices. Examples thereof include a display device of a cellular phone device, a display device of a car navigation system, a fluorescent light, a PDP, and so on.

Furthermore, in the above-described embodiment, the core is constituted by a case core 20 whose near side and far side are open in FIG. 1 and a cover core 50. However, the core is not limited thereto. For example, the side wall 21 may be formed to surround all the circumference of side edges of the case core 20.

Further, in the above-described embodiment, the upper flange portion 31*a*, the middle flange portion 31*b*, and the lower flange portion 31*c* are sequentially formed at least on a side of the arc of the winding portion 31 where the two winding portions 31 do not oppose each other. However, these upper flange portion 31*a*, middle flange portion 31*b*, and lower flange portion 31*c* are not necessarily formed in this manner. For example, an intermittent shape may be adopted such that a part of the upper flange portion 31*a*, the middle flange portion 31*b*, and the lower flange portion 31*c* is cut-out at a predetermined interval.

What is claimed is:

1. A leakage transformer, comprising:

a primary winding constituted by winding a conducting wire;

a secondary winding arranged to be stacked in a height direction of said primary winding and constituted by winding a conducting wire that is different from the conducting wire of said primary winding;

a first terminal block comprising a plurality of primary side terminals to which one end and the other end of said primary winding are respectively bound and a first wrapping terminal to which one end of said secondary winding is bound;

a second terminal block comprising a second wrapping terminal to which the other end of said secondary winding is bound;

a plurality of two-step coil bobbins each having a first winding frame portion to which said primary winding is wound and a second winding frame portion to which said secondary winding is wound;

an adjustment coil bobbin arranged between said plurality of two-step coil bobbins and to which an adjustment portion for adjusting a magnetic coupling of said primary winding is wound; and a core having pillar portions holding said two-step coil bobbins and said adjustment coil bobbin respectively, side walls surrounding outside of the pillar portions, and a recessed portion surrounded by the side walls into which said two-step coil bobbins and said adjustment coil bobbin are fitted, wherein said two-step coil bobbins integrates said first terminal block and said second terminal block.

2. The leakage transformer according to claim 1, wherein a direction of a tip of the first wrapping terminal is oblique in an angle range of approximately 30 to 60 degrees with respect to a direction of tips of the primary side terminals.

3. The leakage transformer according to claim 1, wherein each of said two-step coil bobbins has an upper flange portion, a middle flange portion, and a lower flange portion, and wherein the first winding frame portion is provided between the upper flange portion and the middle flange portion, and the second winding frame portion is provided between the middle flange portion and the lower flange portion.

4. The leakage transformer according to claim 1, wherein the first wrapping terminal is formed in a bar-shape body, and wherein tip sides of the primary side terminals and a ground terminal project toward a bottom surface of said core farther than the first wrapping terminal.

5. The leakage transformer according to claim 1, wherein said core comprises:

a case core comprising the pillar portions provided to stand upward from a bottom surface and the side walls provided to stand upward at an outer peripheral portion of the bottom surface; and a cover core attached to said case core, said two-step coil bobbins and said adjustment coil bobbin being accommodated in a space between said case core and said cover core.

6. The leakage transformer according to claim 1, wherein the first wrapping terminal is provided so that a direction of a tip thereof is oblique with respect to a direction of tips of the primary side terminals in a state that a distance between a tip side of the first wrapping terminal and tip sides of the primary side terminals is wider than a distance between a root of the first wrapping terminal on said first terminal block and roots of the primary side terminals on said first terminal block.

7. The leakage transformer according to claim 1, wherein a direction of a tip of the first wrapping terminal is oblique in an angle range of approximately 30 to 60 degrees with respect to a direction of tips of the primary side terminals.

8. The leakage transformer according to claim 1, wherein the first wrapping terminal is electrically connected to a ground terminal to be connected to a ground, and wherein the ground terminal is arranged adjacent to the first wrapping terminal.

9. A leakage transformer, comprising:

a primary winding constituted by winding a conducting wire;

a secondary winding arranged to be stacked in a height direction of said primary winding and constituted by winding a conducting wire that is different from the conducting wire of said primary winding;

a first terminal block comprising a plurality of primary side terminals to which one end and the other end of said primary winding are respectively bound and a first wrapping terminal to which one end of said secondary winding is bound;

a second terminal block comprising a second wrapping terminal to which the other end of said secondary winding is bound;

wherein a direction of a tip of the first wrapping terminal is oblique in an angle range of approximately 30 to 60 degrees with respect to a direction of tips of the primary side terminals;

wherein the first wrapping terminal is electrically connected to a ground terminal to be connected to a ground, wherein the ground terminal is arranged adjacent to the first wrapping terminal; and wherein a root of the first wrapping terminal on said first terminal block is located on a more central side in a short side direction of a case core than roots of the primary side terminals and the ground terminal on said first terminal block.

* * * * *